US005393077A

United States Patent [19]

Wanous

[11] Patent Number: 5,393,077

[45] Date of Patent: Feb. 28, 1995

[54] ALL SEASON SKATE

[76] Inventor: Craig C. Wanous, 4001 Overlook Dr., Bloomington, Minn. 55437

[21] Appl. No.: 25,033

[22] Filed: Mar. 1, 1993

[51] Int. Cl.[6] ..... A63C 17/18

[52] U.S. Cl. ..... 280/7.13; 280/11.22; 280/11.27; 280/600

[58] Field of Search ..... 280/7.13, 7.14, 7.12, 280/7.1, 11.22, 11.27, 600, 9, 10

[56] References Cited

U.S. PATENT DOCUMENTS

| | | | |
|---|---|---|---|
| 3,351,353 | 11/1967 | Weitzner | 280/7.13 |
| 4,026,045 | 5/1977 | Druss | 36/108 |
| 4,150,499 | 4/1979 | Wang | 36/115 |
| 4,188,046 | 2/1980 | Fleckenstein | 280/600 |
| 4,492,385 | 1/1985 | Olson | 280/7.13 |
| 4,666,169 | 5/1987 | Hamill et al. | 280/11.23 |
| 4,932,675 | 6/1990 | Olson et al. | 280/7.13 |
| 5,127,672 | 7/1992 | Horibata | 280/842 |

FOREIGN PATENT DOCUMENTS

| | | | |
|---|---|---|---|
| 376068B | 8/1991 | European Pat. Off. . | |
| 587297 | 4/1947 | United Kingdom | 280/7.13 |

OTHER PUBLICATIONS

SnowRunner brochure, SnowRunner (USA), Inc., 1993.

*Primary Examiner*—Karin L. Tyson
*Assistant Examiner*—Kevin Hurley
*Attorney, Agent, or Firm*—Dorsey & Whitney

[57] ABSTRACT

The skate of the present invention includes a foot receiving boot having a substantially rigid shell and sole. A frame is fixedly attached to the sole and includes a forward frame portion and a rear frame portion. The frame portion, and thus the skate, is adapted to receive interchangeably a wheeled truck for in-line roller skating, a blade-carrying truck for ice skating, and a ski for use on snow. The ski assembly includes a ski member and an adapter wherein the adapter is releasably attached to the boot and the ski is releasably connected to the adapter. The adapter includes a bottom surface that facilitates walking when the ski is removed.

11 Claims, 6 Drawing Sheets

ALL SEASON SKATE

TECHNICAL FIELD

The present invention relates to skates. In particular, it relates to an "in-line" type of training or recreational skate for use in any season wherein the skate interchangeably carries a wheeled truck, blade or ski.

BACKGROUND OF THE INVENTION

Skating has been a well known and popular form of recreation for a long time. Traditionally, it was a seasonal activity performed with a blade carrying skate on ice in winter and with a wheeled skate on smooth paved surfaces in warm weather, but rink facilities creating artificial conditions enabled people to ice skate in warm weather and roller skate in winter. Separate bladed or wheeled skates were still required.

The next development was a shoe or boot adaptable to carry interchangeably a blade or plurality of wheels or rollers. Such skates are represented by the skate or skate devices disclosed in U.S. Pat. Nos. 3,351,353 (to Weitzner) and 4,666,169 (to Hamill et al.). The Hamill et al. skate apparatus requires a bifurcated truck assembly which must be disconnected from the sole of the shoe and disassembled to switch between wheels and the optional ice skate attachment. The Weitzner patent is directed to a skating shoe with retractable, interchangeable blades, rollers or jump springs. The shoe has a thick sole with a central longitudinal channel having an open rear end and a closed front end. A plate member supporting the springs, rollers or blade is retractably received in the channel and, when retracted, can be covered by a separate plate so that the shoe can be used for walking with a flat sole and heel. There is no disclosure or suggestion in either the Weitzner or Hamill et al. patent about how to provide an interchangeable ski structure for skating in snow.

Two other patents disclosing the concept of interchangeability in skate devices are U.S. Pat. Nos. 4,150,499 (to Wang) and 5,127,672 (to Horibata). The latter patent discloses a hopping roller skate for the training of skiing wherein the shoe can function in its usual manner when separated from the roller structure. However, the shoe would be unsuitable for substantially normal walking to and from a place of use. While the Wang shoe might be used for normal walking after the blade or rollers are removed, a disadvantage is that it is a sandal type shoe and provides no or very limited support for a user's ankles. Neither Wang or Horibata suggest that a ski could be interchangeably connected to the respective shoes.

U.S. Pat. Nos. 4,492,385 (to Olson) and 4,932,675 (to Olson et al.) disclose skates having an interchangeable operative portion, a blade or wheel assembly, fastened to a shoe or boot. Frame members are attached to the sole of the boot and have recesses on each side for receiving beams or edges of the interchangeable blade or wheel assemblies. There is no disclosure or suggestion about how a ski could be releasably or interchangeably connected to the shoe or boot.

It would be advantageous if a convertible sport and training skate could be provided for use in any season, wherein the skate could be adapted to become a roller skate, an ice skate or a snow skate.

SUMMARY OF THE PRESENT INVENTION

The skate of the present invention includes a foot receiving boot having a substantially rigid shell and sole. A frame is fixedly attached to the sole and includes a forward frame portion and a rear frame portion. The frame portion, and thus the skate, is adapted to receive interchangeably a wheeled truck for in-line roller skating, a blade-carrying truck for ice skating, and a ski for use on snow. The ski assembly includes a ski member and an adapter wherein the adapter is releasably attached to the boot and the ski is releasably connected to the adapter. The adapter includes a bottom surface that facilitates walking to and from a place of exercise when the ski is removed.

The skate has front and rear attachment portions adapted to be incorporated with or attached to the sole and heel of the boot. An elongate removable sub-assembly including a molded polymeric frame has a lower portion for carrying an ice blade or wheels and spaced front and rear upper portions each having spaced side wall portions. The skate also includes an elongated generally bone-shaped removable adapter subassembly, with front and rear portions carrying forwardly and rearwardly extending tongues, a narrow medial finger-receiving area, and a ski. All the front and rear upper portions can be releasably attached to the attachment portions by a tongue and groove arrangement, and a fastener is provided for retaining the subassemblies on the boot.

The present invention is designed specifically to enable skating in any season and to facilitate cross-training for athletes. It enables outdoor skating in winter or summer, on ice or snow, and improves the stability and performance of the skate when being used in any of its modes.

The skate of the present invention is easy to use, and when adapted for use in winter, the ski can be detached easily so that the user can walk normally to and from the place of use without damaging the snow-contacting surface of the ski.

An object of the present invention is to provide a convertible recreational and training skate for use in any season.

Another object of the present invention is to provide a skate including a ski assembly, wherein the ski assembly comprises a ski member and an adapter, and further wherein the adapter facilitates the convenient attachment and removal of the ski and provides a ribbed walking surface.

The skate of the present invention is easily convertible to a wheeled skate, a bladed skate and a ski skate, and thereby facilitates cross-training and recreational enjoyment in any season, particularly for in-line skaters.

DETAILED DESCRIPTION OF THE INVENTION

Figure 1:
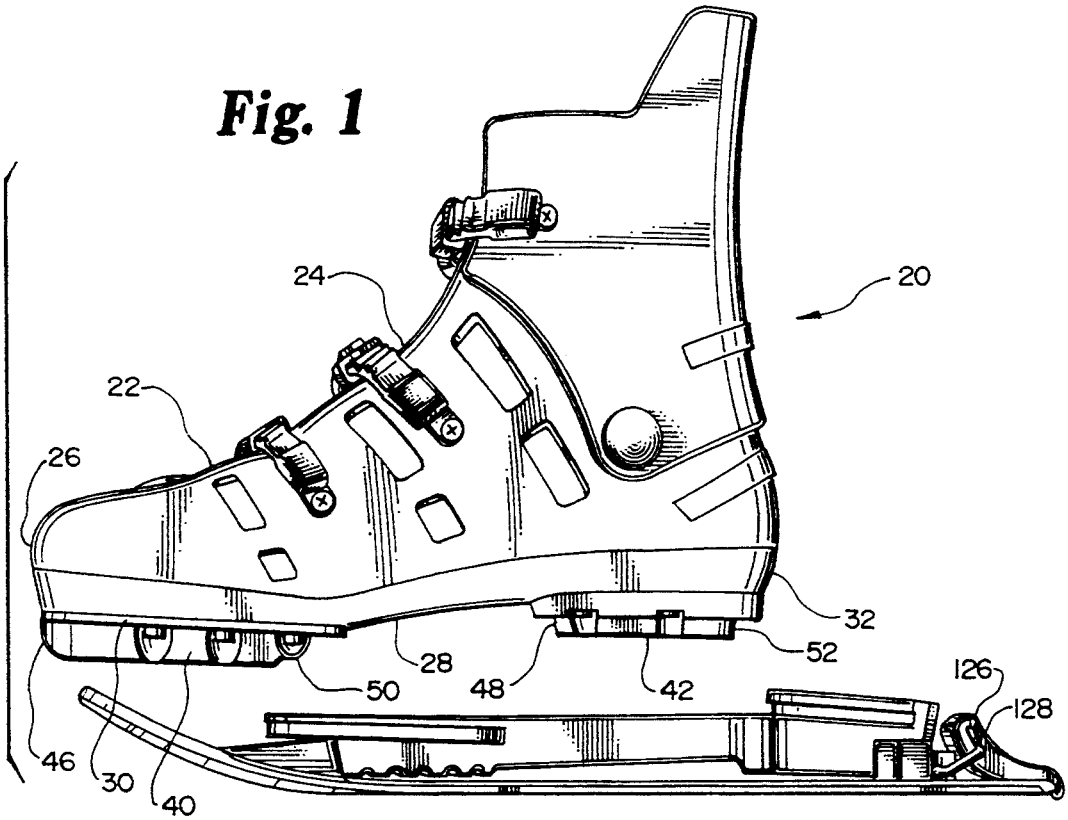
FIG. 1 is a side elevation view of the convertible skate of the present invention.
Figure 9:
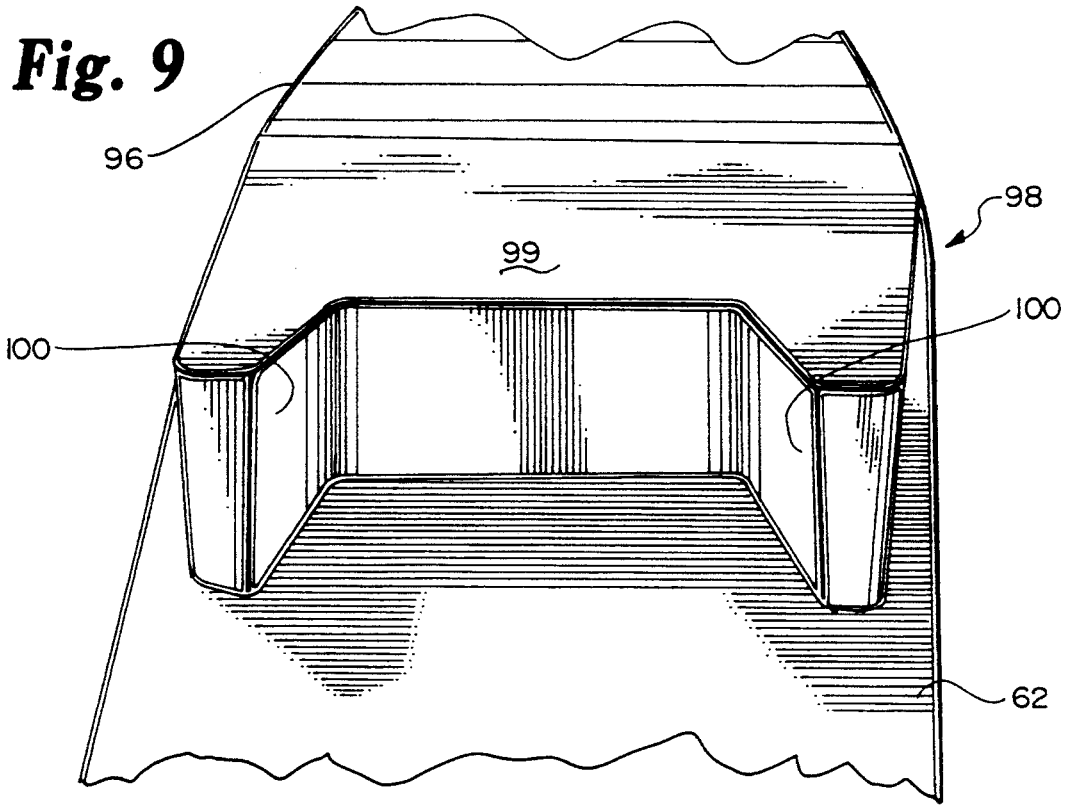
FIG. 9 is a detailed perspective showing the front mount of the ski member.
Figure 10:
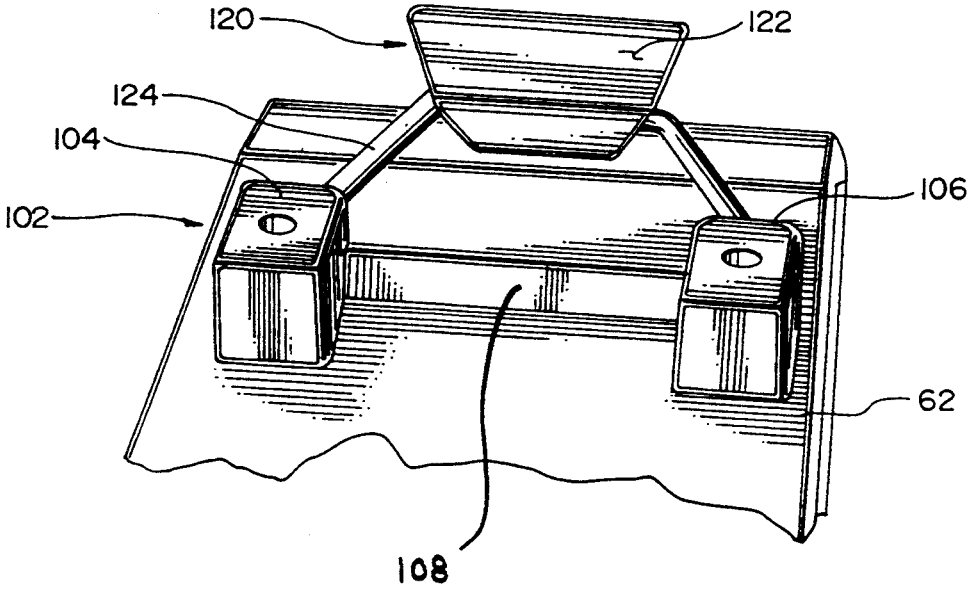
FIG. 10 is a detailed perspective showing the rear mount of the ski member.
Figure 11:
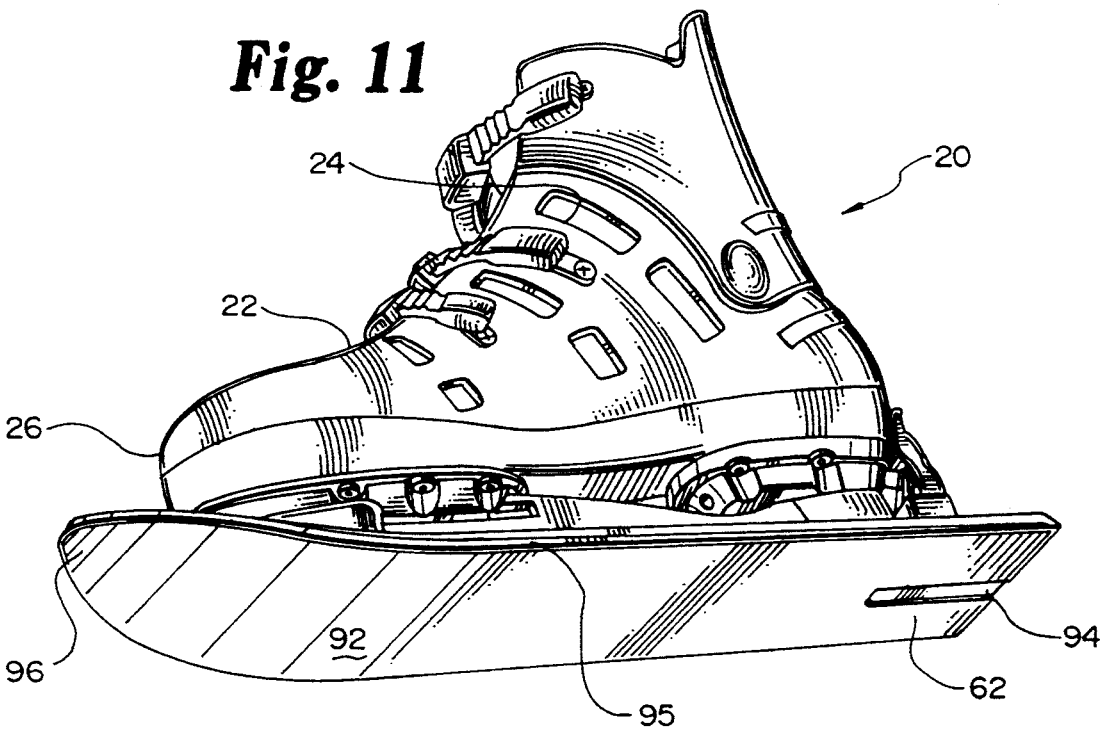
FIG. 11 is a perspective view showing the ski assembly mounted on the boot and ready for use.

FIGS. 1–11 depict one of a pair of convertible skates 20 in accordance with the present invention. Referring to FIGS. 1 and 11, the skate 20 includes a boot 22 having an upper vamp section 24, a lower vamp section 26 and a sole 28. The sole includes a front ball receiving area 30 and a rear heel area 32. The lower vamp section 26 extends generally upwardly from the sole to provide support for the lower foot area. The upper vamp section 24 includes a typical opening to receive a user's foot. The boot 22 may be molded of an appropriate synthetic material.

Figure 3:
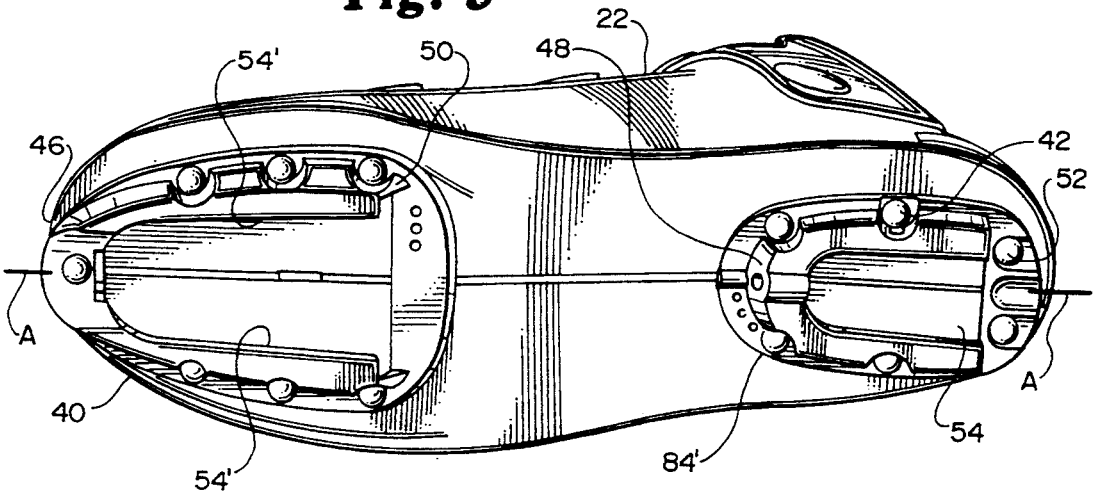
FIG. 3 is an elevational view of the frame member of the boot of the present invention.

Referring to FIGS. 1 and 3, the boot 22 permanently carries or includes front and rear attachment frame members 40, 42, respectively. The frame members 40, 42, specifically the peripheries thereof, generally follow the foot or sole profile of the boot to provide better responsiveness and performance when a ski, skate or blade is installed. Each frame member 40, 42 includes a front end 46, 48, respectively, a rear end 50, 52, respectively, and opposite sides extending between the front and rear ends. The rear frame member 42 has a generally parallel, inwardly facing edges 54 which extend parallel with the longitudinal center line of the boot, represented by line A in FIG. 3. Similarly, the front frame member 40 has edges 54' but, toward the front of the boot, the edges 54' curve or angle toward each other.

Figure 4:
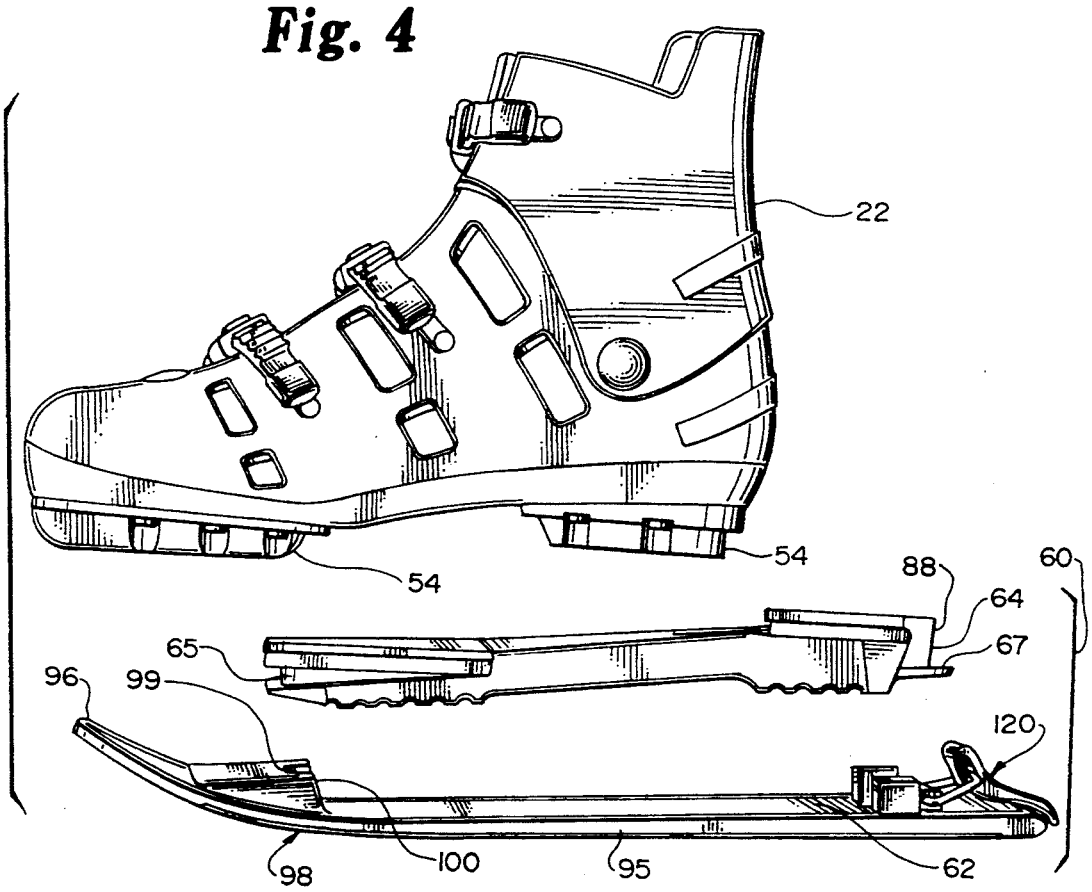
FIG. 4 is an elevational view of the skate of the present invention including the boot and the ski assembly, and depicts an initial step in the connection of the ski assembly to the boot.
Figure 7:
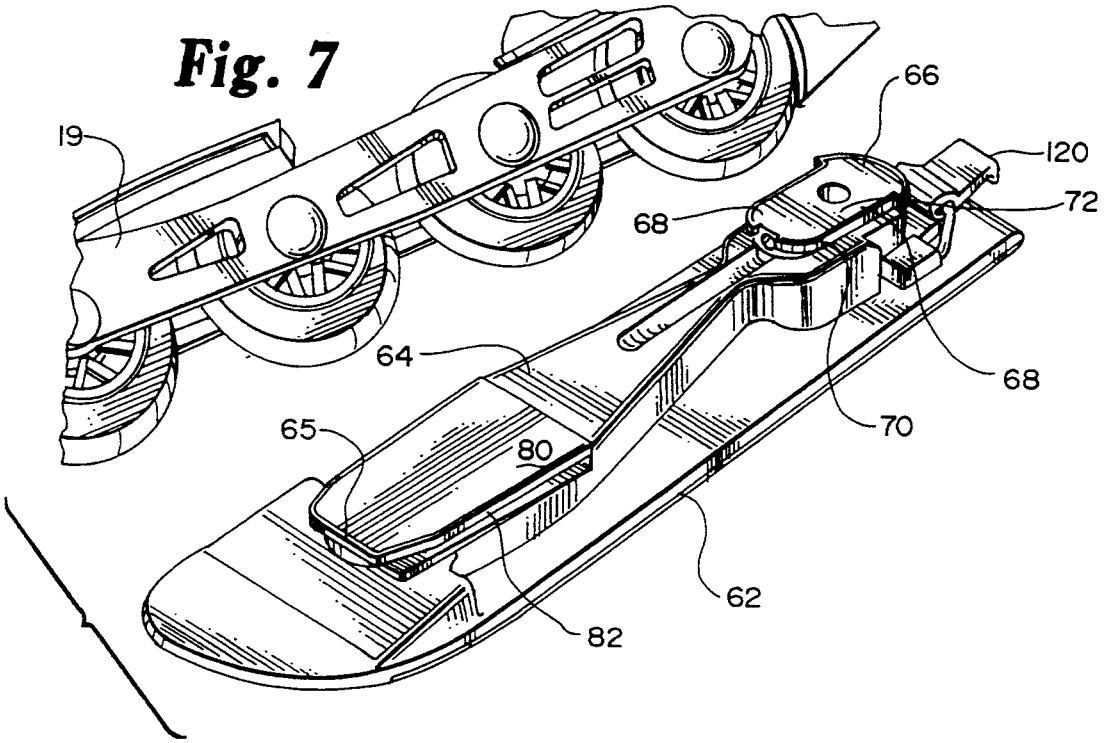
FIG. 7 is a perspective view of the boot contacting surface of the adapter of the present invention and shows the ski member partially connected to the adapter.

Referring to FIGS. 4 and 7, the skate of the present invention includes an interchangeable ski assembly 60 including a ski 62 and an adapter 64. The adapter 64 includes attachment means for releasably engaging the front and rear frame members 40, 42 fixedly connected to the sole 28 of the boot 22. Specifically, the rear portion 66 of the adapter 64 includes a rear flange 67 and opposed sidewall portions 68, each having a groove 70 along its outer surface. The grooves 70 are defined by upper and lower opposed surfaces and innermost recessed surfaces, are generally parallel to the adapter upper surface 72.

The inside edges 54 of the rear attachment frame member 42 are adapted to enter the grooves 70 wherein they are closely engaged and wherein the rear 66 of the adapter 64 is held close to the heel area of the sole 28 of the boot 22.

The adapter 64 includes a front portion 80 carrying a front tongue 65 and opposed grooves 82 on the outside edges thereof. The grooves 82 are adapted to receive the side edges 54' of the front attachment frame member 40.

Figure 2:
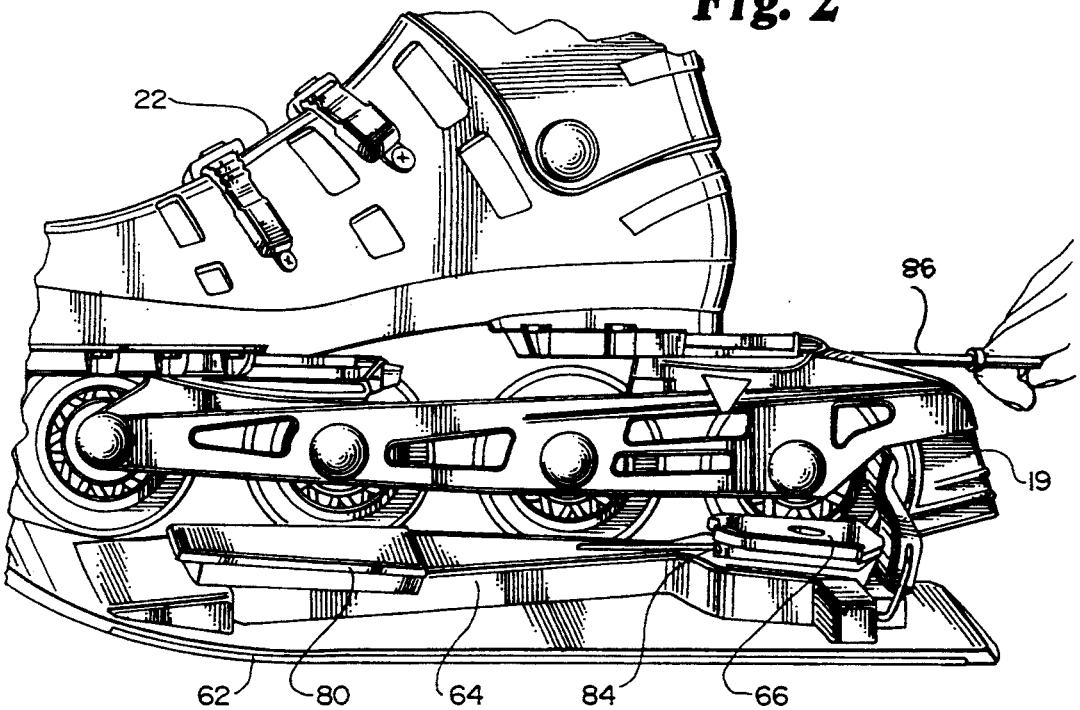
FIG. 2 is an elevational view of the skate depicting the removal of the in-line wheeled truck, and including, in the foreground, a perspective view of the ski assembly of the present invention.

Referring to FIG. 2 and 3, fastening means are provided to retain the adapter 64 in the front and rear frame members 40, 42. The rear portion 66 of the adapter 64 and the front of the frame member 42 include a threaded portion 84 and 84' for receiving a fastening member 86 such as an allen-headed bolt.

The bolt 86 is inserted in an opening 88 and as depicted in FIG. 2, a tool or allen wrench may be used to engage the bolt 86 with the threaded portions 84, 84' to fasten the adapter 64 in place relative to the boot. Similar fastening structure may be provided for the wheel and blade trucks.

Referring to FIGS. 7 and 9–11, the present invention includes a ski 62. The ski includes a typical, generally planar bottom surface 92 (shown in FIG. 11), including a rear steering channel 94 and an upturned, generally pointed tip 96. Steel side edges 95 may be provided.

Referring specifically to FIG. 9, just rearwardly from the tip 96, the ski 62 includes a front tongue receiving shoulder 98 with a flange 99. The shoulder 98 receives the front tongue 65 of the adapter 64, and includes rounded side guide surfaces, both indicated at 100, for guiding the tongue 65 into alignment with the central longitudinal axis of the ski 62.

The ski 62 also includes a rear mounting shoulder 102 (FIG. 10). The rear shoulder comprises two spaced, generally rectangular upstanding side centering blocks 104, 106 and a flat-topped center table 108 extending generally perpendicularly between the blocks 104, 106 and transversely across the ski surface.

The ski 62 also carries a manually operable latch mechanism 120 to secure the ski 62 to the adapter 64 with the ski central longitudinal axis generally parallel to the central longitudinal axis of the adapter 64. The latch mechanism 120 comprises an eccentric camming mechanism 122 pivotally mounted on a wire-like bracket 124 pivotally connected to the center table 108. In use, when the ski 62 is positioned on the adapter 64, and the rear flange 67 of the adapter 64 is in contact with the center table 108, the camming mechanism 122 is pivoted to engage the flange 67 and to secure the ski 62 to the adapter 64 (as shown in FIG. 1). A handle 126 is provided on the cam mechanism 122 and the cam mechanism 122 includes a generally central rubberized resilient portion 128 so that it can be operated more easily and to bias it in place.

In use, the wheeled truck 19 (shown in FIGS. 2 and 7) is removed from the boot 22 of the present invention by loosening the allen-bolt 86 and sliding it rearwardly relative to the boot 22 as depicted in FIG. 2. The truck 19 is slid rearwardly and removed to open the front and rear mounting frames 40, 42 to receive the adapter 64 (FIGS. 3 and 4).

Figure 8:
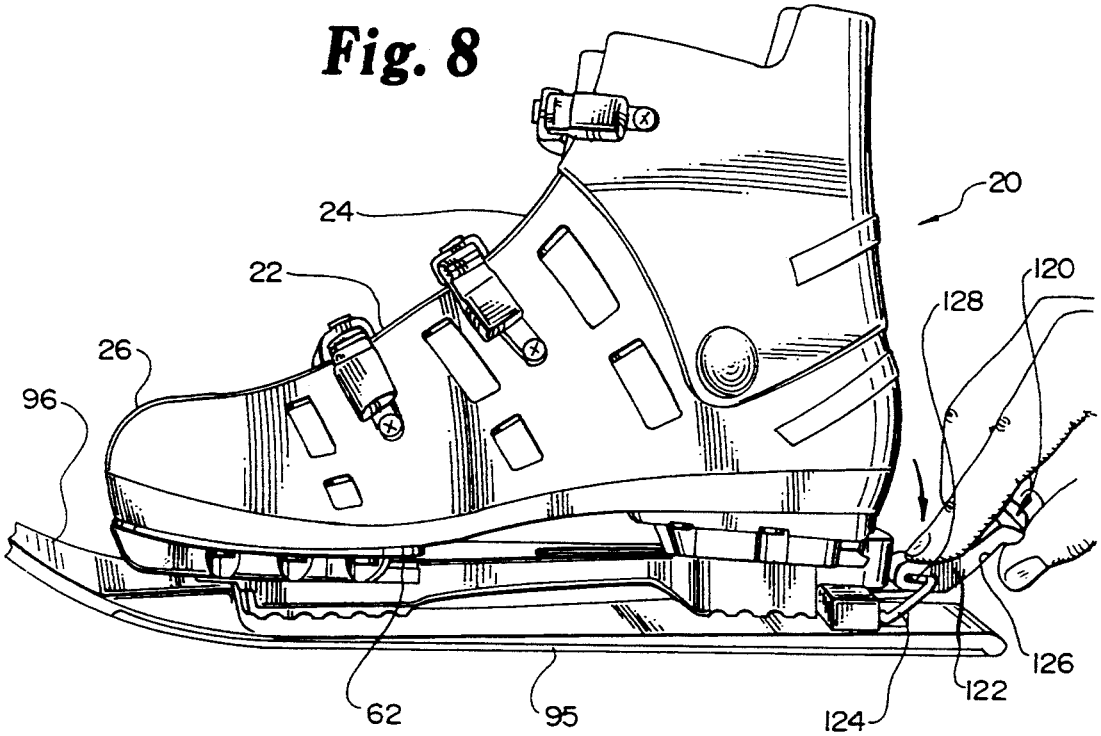
FIG. 8 is an elevational view depicting the ski assembly being mounted on the boot for use.

Next, the user may attach the ski assembly 60 to the boot 22. This is done with the adapter 64 separated from the ski 62 as depicted in FIG. 4. The adapter 64, particularly the front and rear attachment means thereof, is aligned with the edges 54', 54 of the front and rear mounting members 40, 42 of the boot. The adapter 64 is then pushed toward the toe end of the boot 22 and the allen bolt 86 is inserted in the aperture 88 at the rear end of the adapter 64 above the flange 67 and tightened in place to lock the adapter to the boot 22. To attach the ski 62, the tongue 65 of the adapter is inserted into the front mounting shoulder 98 of the ski 62 and the flange 67 at rear of the adapter is placed between the spacer blocks 104, 106 thereby aligning the longitudinal axes of the ski 62, the adapter 64 and the boot 22. The boot is lowered with respect to the ski until the flange 67 contacts the center block 108. The latch mechanism 120 can be manipulated as outlined above and as depicted in FIG. 8 to fully lock the ski 62 in place on the adapter 64.

Figure 5:
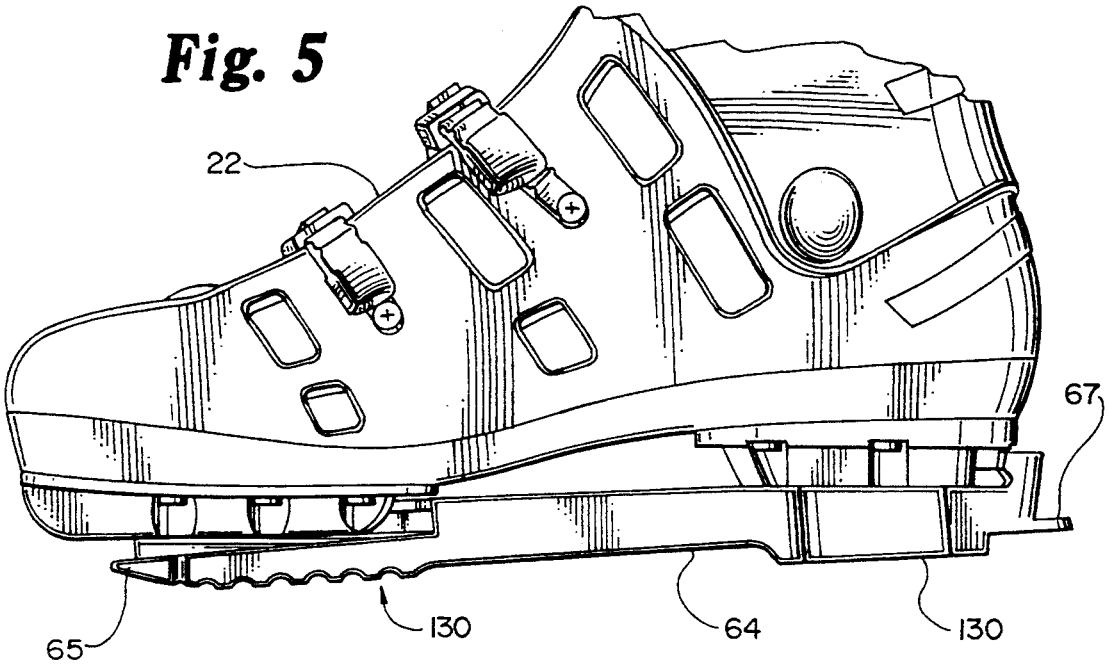
FIG. 5 is an elevational view of the adapter of the ski assembly of the present invention connected to the boot.
Figure 6:
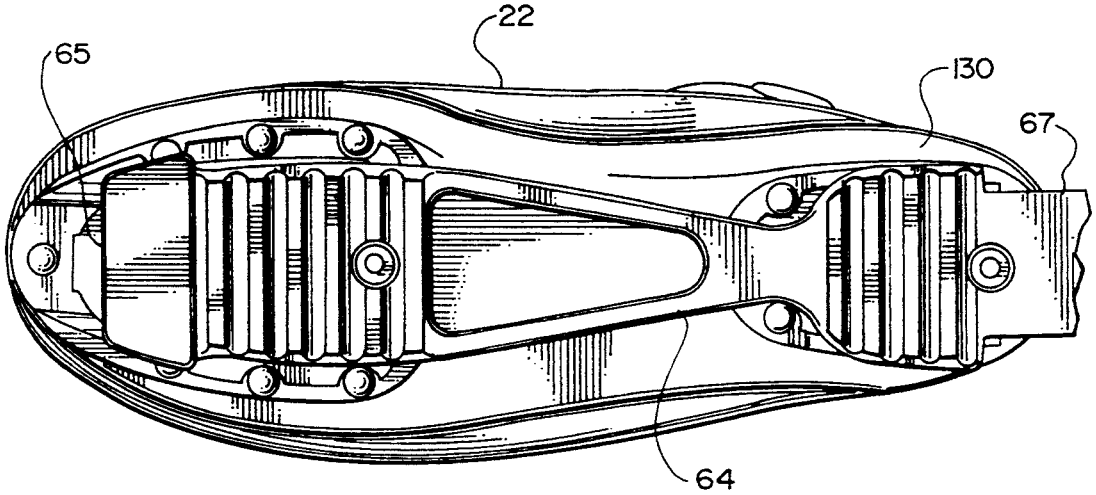
FIG. 6 is an elevational view of the walking surface of the adapter.

A particular advantage of the present invention is that when the user is finished snow skating, the latch mechanism 120 can be released and the user may simply step away from the ski 62. The bottom walking surface 130 of the adapter (as shown in FIGS. 4–6) enables the user to walk safely and in a generally normal walking motion and pace away from the place of exercise. This ski removal feature avoids damaging the snow contacting bottom surface of the ski 62 and is much more comfortable for the user.

Any suitable material, such as appropriate polymers, plastics or fiberglass may be used to form all or a portion of the boot, the interchangeable wheeled trucks, blade trucks or ski assemblies of the present invention, provided that the selected material is sufficiently strong and light. The latch mechanism 120 may take the form of a spring-loaded detent system or a typical ski binding system. Additionally, it may be modified to provide an automatic safety release or kick-off mechanism for the ski 62. These skis for use in the present invention may be of selected length depending upon the skill of the user and the desired performance characteristics of the ski. The wheeled or blade trucks for use in the present invention may be of the type disclosed in U.S. Pat. No. 4,932,675, but any suitable wheel or skate assembly may be used.

Although a description of the preferred embodiment of the present invention is presented, various changes, including those mentioned above, could be made without deviating from the spirit of the present invention. It is therefore desired that reference be made to the appended claims rather than to the foregoing description to indicate the scope of the invention.

What is claimed is:

1. A skate assembly forming a snow skate including a ski carried by a boot, said skate assembly comprising:

front and rear attachment portions having front and rear ends, and opposite side surfaces extending between said front and rear ends, said attachment portions attached respectively to the sole and heel of the boot with the front ends of the attachment portions adjacent the front end of the boot; and an elongate sub-assembly including a molded polymeric frame having a front end and a rear end, said frame including:

a middle portion extending between said front and rear ends and spaced front and rear portions each having an uppermost surface, a bottom surface opposite to said uppermost surface, opposite spaced side wall portions, and front and rear ends;

means for releasably engaging said rear portion to said rear attachment portion and said front portion to said front attachment portion comprising, for each pair of engaged portions, a pair of grooves extending from an inlet adjacent one of the ends of the front and rear portions toward the other of the ends of the portions, each groove extending along a different one of the side surfaces of said portions; and said attachment portions having at least one part adapted to extend along said side surfaces of said side wall portions and including a pair of tongues having opposite upper and lower surfaces and distal surfaces extending from one of the ends of the attachment portion toward the other of the ends of the attachment portions, each tongue adapted to enter a different one of said grooves from said inlet to an engaged position with said surfaces of said grooves and tongues in frictional engagement; and fastening means for fixing said sub-assembly to said boat including a fastening member attached to one of said portions.

2. The skate assembly according to claim 1, wherein said sub-assembly includes a walking surface opposite each of said uppermost surfaces.

3. The skate assembly according to claim 2, wherein said ski is removably attached to said sub-assembly.

4. A convertible skate including a wheeled truck, a blade carrying truck and a ski assembly for use as a roller skate, an ice skate or a snow skate respectively, said skate comprising:

a boot having an upper and a sole, said boot carrying a frame on said sole, said frame including a front frame member and a rear frame member each having side walls with a channel formed therein, the wheeled truck, blade carrying truck and ski assembly including means complimentary to said frame, whereby the wheeled truck, the blade carrying truck and the ski assembly may be selectively and interchangeably operably carried by said boot.

5. The skate according to claim 4, wherein said ski assembly comprises a ski and an adapter for connecting said ski to said boot, said adapter having a front and a rear portion for being removably received by said front and rear frame members respectively, each front and rear portion having an uppermost surface and a walking surface generally parallel to said front and rear plates.

6. An assembly for attaching a ski to a boot, said assembly comprising:

front and rear attachment portions having front and rear ends, and opposite side surfaces extending between said front and rear ends, said attachment portions being attached respectively to a sole and heel portion of the boot; and an elongate sub-assembly including a molded polymeric frame having a front end and a rear end, said frame including:

a middle portion extending between said front and rear ends and spaced front and rear portions each having an uppermost surface, a bottom walking surface opposite each said uppermost surface, opposite spaced side wall portions, and front and rear ends;

means for releasably engaging said rear portion to said rear attachment portion and said front portion to said front attachment portion comprising, for each pair of engaged portions, a pair of grooves extending from an inlet adjacent one of the ends of the front and rear portions toward the other of the ends of the portions, each groove extending along a different one of the side surfaces of said portions; and said attachment portions having at least one part adapted to extend along said side surfaces of said side wall portions and including a pair of tongues having opposite upper and lower surfaces and distal surfaces extending from one of the ends of the attachment portion toward the other of the ends of the attachment portions, each tongue adapted to enter a different one of said grooves from said inlet to an engaged position with said surfaces of said grooves and tongues in frictional engagement; and fastening means for fixing said sub-assembly to said boot including a fastening member attached to one of said portions.

7. The assembly according to claim 6, wherein the assembly includes a ski and wherein the ski is removably attached to said sub-assembly.

8. The assembly according to claim 7, wherein the bottom walking surface is textured.

9. An assembly for attaching a ski to a boot, said assembly comprising:

front and rear attachment portions having front and rear ends, and opposite side surfaces extending between said front and rear ends, said attachment portions being attached respectively to a sole and heel portion of the boot; and an elongate sub-assembly including a molded polymeric frame having a front end and a rear end, said frame including:

a middle portion extending between said front and rear ends and spaced front and rear portions each having an uppermost surface, a front and rear bottom walking surface opposite and generally parallel to each respective said uppermost surface, opposite spaced side wall portions, and front and rear ends;

means for releasably engaging said rear portion to said rear attachment portion and said front portion to said front attachment portion comprising, for each pair of engaged portions, a pair of grooves extending from an inlet adjacent one of the ends of the front and rear portions toward the other of the ends of the portions, each groove extending along a different one of the side surfaces of said portions; and said attachment portions having at least one part adapted to extend along said side surfaces of said side wall portions and including a pair of tongues having opposite upper and lower surfaces and distal surfaces extending from one of the ends of the attachment portion toward the other of the ends of the attachment portions, each tongue adapted to enter a different one of said grooves from said inlet to an engaged position with said surfaces of said grooves and tongues in frictional engagement; and fastening means for fixing said sub-assembly to said boot including a fastening member attached to one of said portions.

10. The skate according to claim 4, wherein said ski assembly comprises a ski and said means complimentary to said frame, said means complimentary to said frame being separable from the ski and comprising an elongate sub-assembly including:

a middle portion and spaced front and rear portions each having an uppermost surface, a front and rear bottom walking surface opposite and generally parallel to each respective said uppermost surface, and opposite spaced side walls;

means for releasably engaging said rear portion to said rear frame member and said front portion to said front frame member comprising a pair of grooves extending from an inlet adjacent one of the ends of the front and rear portions toward the other of the ends of the portions, each groove extending along a different one of the side walls of said portions; and said front and rear frame members each having a pair of tongues for entering a different one of said grooves from said inlet and moving to an engaged position with said grooves and tongues in frictional engagement.

11. The skate according to claim 10 and a fastening member for fixing said sub-assembly to said boot in said engaged position.

* * * * *